US009822634B2

(12) United States Patent
Gao

(10) Patent No.: US 9,822,634 B2
(45) Date of Patent: Nov. 21, 2017

(54) DOWNHOLE TELEMETRY SYSTEMS AND METHODS WITH TIME-REVERSAL PRE-EQUALIZATION

(75) Inventor: Li Gao, Katy, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 99 days.

(21) Appl. No.: 14/380,005

(22) PCT Filed: Feb. 22, 2012

(86) PCT No.: PCT/US2012/026109

§ 371 (c)(1),
(2), (4) Date: Aug. 20, 2014

(87) PCT Pub. No.: WO2013/126054

PCT Pub. Date: Aug. 29, 2013

(65) Prior Publication Data

US 2015/0015413 A1 Jan. 15, 2015

(51) Int. Cl.
*G01V 3/00* (2006.01)
*E21B 47/16* (2006.01)

(52) U.S. Cl.
CPC ..... *E21B 47/16* (2013.01)

(58) Field of Classification Search
CPC ..... E21B 47/16
USPC ..... 340/854.4; 375/224
See application file for complete search history.

(56) References Cited

U.S. PATENT DOCUMENTS 2,810,546 A 10/1957 Eaton et al.
3,588,804 A 6/1971 Fort
3,790,930 A 2/1974 Lamel et al.
3,813,656 A 5/1974 Fowler et al.
4,282,588 A 8/1981 Chanson et al.
4,283,779 A 8/1981 Lamel
4,302,826 A 11/1981 Kent et al.
4,314,356 A 2/1982 Scarborough
(Continued)

FOREIGN PATENT DOCUMENTS

CN 101610117 12/2009
FR 2868894 10/2005
(Continued)

OTHER PUBLICATIONS

Lerosey, G. et al., "Time Reversal of Electromagnetic Waves", Physical Review Letters, Mar. 14, 2004, 3 pgs., vol. 92(19).
(Continued)

*Primary Examiner* — Zhen Y Wu
(74) *Attorney, Agent, or Firm* — John W. Wustenberg; Tumey L.L.P.

(57) ABSTRACT

Specific embodiments of disclosed downhole telemetry systems and methods employ time-reversal pre-equalization. One downhole telemetry system embodiment includes an acoustic transducer and a digital signal processor. The acoustic transducer transmits an acoustic signal to a distant receiver via a string of drillpipes connected by tool joints. The digital signal processor drives the acoustic transducer with an electrical signal that represents modulated digital data convolved with a time-reversed channel response. Due to the use of time-reversal pre-equalization, the received signal exhibits substantially reduced intersymbol interference.

17 Claims, 4 Drawing Sheets

(56) References Cited

U.S. PATENT DOCUMENTS

| | | | | |
|---|---|---|---|---|
| 6,145,378 | A * | 11/2000 | McRobbie | E21B 47/00 166/254.1 |
| 6,320,820 | B1 | 11/2001 | Gardner et al. | |
| 6,370,082 | B1 | 4/2002 | Gardner et al. | |
| 6,470,275 | B1 | 10/2002 | Dubinsky | |
| 7,158,446 | B2 | 1/2007 | Gardner et al. | |
| 7,587,291 | B1 * | 9/2009 | Sarvazyan | A61N 7/02 600/407 |
| 7,653,137 | B2 | 1/2010 | Fink et al. | |
| 8,193,946 | B2 | 6/2012 | Sinanovic et al. | |
| 2002/0010547 | A1 * | 1/2002 | Hall | E21B 7/04 702/6 |
| 2005/0024232 | A1 * | 2/2005 | Gardner | G01V 11/002 340/854.4 |
| 2005/0232084 | A1 * | 10/2005 | DiNapoli | G10K 11/346 367/139 |
| 2006/0055556 | A1 * | 3/2006 | Memarzadeh | E21B 47/12 340/870.07 |
| 2007/0071077 | A1 * | 3/2007 | Yang | H04B 13/02 375/218 |
| 2008/0285386 | A1 * | 11/2008 | Sinanovic | E21B 47/16 367/82 |
| 2009/0171254 | A1 | 7/2009 | Kushculey et al. | |
| 2009/0285054 | A1 * | 11/2009 | Song | E21B 47/182 367/84 |
| 2009/0309805 | A1 | 12/2009 | Fink et al. | |
| 2010/0039286 | A1 | 2/2010 | Robbins et al. | |
| 2010/0085902 | A1 | 4/2010 | Phan Huy et al. | |
| 2010/0290025 | A1 * | 11/2010 | Parker | G01S 7/497 356/3 |
| 2011/0005835 | A1 * | 1/2011 | Li | E21B 47/182 175/48 |
| 2011/0103620 | A1 * | 5/2011 | Strauss | H04S 3/00 381/150 |
| 2011/0286508 | A1 * | 11/2011 | Smith | H04L 25/03343 375/224 |
| 2012/0057510 | A1 * | 3/2012 | Phan Huy | H04B 7/0413 370/281 |
| 2012/0328037 | A1 * | 12/2012 | Hsu | G01S 1/725 375/267 |
| 2013/0116926 | A1 * | 5/2013 | Rodney | G01V 1/42 702/8 |
| 2013/0279561 | A1 * | 10/2013 | Jin | H04L 25/4902 375/239 |
| 2015/0312081 | A1 * | 10/2015 | Yang | H04B 1/38 375/298 |

FOREIGN PATENT DOCUMENTS

| | | |
|---|---|---|
| FR | 2913555 | 9/2008 |
| GB | 8418086 | 8/1984 |
| GB | 2438037 | 7/2009 |
| WO | WO-02/068995 | 9/2002 |
| WO | WO-2008/007024 | 1/2008 |
| WO | WO-2010/128235 | 11/2010 |
| WO | WO-2011/029075 | 3/2011 |
| WO | WO-2013/126054 | 8/2013 |

OTHER PUBLICATIONS

Fink, Mathias "Time Reversed Acoustics", Physics Today, Mar. 1997, p. 34-40, vol. 50.

PCT International Search Report and Written Opinion, dated May 1, 2012, Appl No. PCT/US2012/026109, "Downhole Telemetry Systems and Methods With Time-Reversal Pre-Equalization", filed Feb. 22, 2012, 9 pgs.

Edelmann, G. F. et al., "Underwater Acoustic Communications Using Time Reversal", IEEE Journal of Oceanic Engineering. vol. 30, No. 4. Oct. 2005, p. 852-864, Retrieved from the internet. Retrieved at <URL:http://www-mpl.ucsd.edu/people/hcsong/papers/edelmann joe05.pdf>.

Proakis, John G., "Digital Communications", Chapter 6, p. 519-692, 1989, 2nd edition, McGraw-Hill Book Company, New York, New York, United States, (1989).

PCT International Preliminary Report on Patentability, dated Sep. 4, 2014, Appl No. PCT/US2012/026109, "Downhole Telemetry Systems and Methods With Time-Reversal Pre-Equalization," Filed Feb. 22, 2012.

* cited by examiner

DOWNHOLE TELEMETRY SYSTEMS AND METHODS WITH TIME-REVERSAL PRE-EQUALIZATION

BACKGROUND

Modern petroleum drilling and production operations demand a great quantity of information relating to parameters and conditions downhole. Such information typically includes characteristics of the earth formations traversed by the borehole, along with data relating to the size and configuration of the borehole itself. The collection of information relating to conditions downhole, which commonly is referred to as "logging", can be performed by several methods.

In conventional oil well wireline logging, a probe or "sonde" that houses formation sensors is lowered into the borehole after some or all of the well has been drilled, and is used to determine certain characteristics of the formations traversed by the borehole. The upper end of the sonde is attached to a conductive wireline that suspends the sonde in the borehole. Power is transmitted to the sensors and instrumentation in the sonde through the conductive wireline. Similarly, the instrumentation in the sonde communicates information to the surface by electrical signals transmitted through the wireline.

However, wireline logging can generally not be performed while the drilling assembly remains in the borehole. Rather, the drilling assembly must be removed before wireline logging can be performed. As a result, wireline logging may be unsatisfactory in situations where it is desirable to determine and control the position and orientation of the drilling assembly so that the assembly can be steered. Additionally, timely information may be required concerning the nature of the strata being drilled, such as the formation's resistivity, porosity, density and its gamma radiation characteristics. It is also frequently desirable to know other downhole parameters, such as the temperature and the pressure at the base of the borehole, for example. Once this data is gathered at the bottom of the borehole, it is necessary to communicate it to the surface for use and analysis by the driller.

In logging-while-drilling (LWD) systems, sensors or transducers are typically located at the lower end of the drill string. While drilling is in progress these sensors continuously or intermittently monitor predetermined drilling parameters and formation data and transmit the information to a surface detector by some form of telemetry. Typically, the downhole sensors employed in LWD applications are built into a cylindrical drill collar that is positioned close to the drill bit. There are a number of existing telemetry systems that seek to transmit information obtained from the downhole sensors to the surface. Of these, the mud pulse telemetry system is one of the most widely used for LWD applications.

In a mud pulse telemetry system, the drilling mud pressure in the drill string is modulated by means of a valve and control mechanism, generally termed a "pulser" or "mud pulser". The data transmission rate, however, is relatively slow due to pulse spreading, distortion, attenuation, modulation rate limitations, and other disruptive forces, such as the ambient noise in the drill string. A typical pulse rate is less than 10 pulses per second (10 Hz). Given the recent developments in sensing and steering technologies available to the driller, the rate data can be conveyed to the surface in a timely manner, a few bits per second, is sorely inadequate.

BRIEF DESCRIPTION OF THE DRAWINGS

Accordingly, there are disclosed in the drawings and the following description specific embodiments of downhole acoustic and mud pulse telemetry systems and methods with time-reversal pre-equalization. In the drawings.

Figure 1:
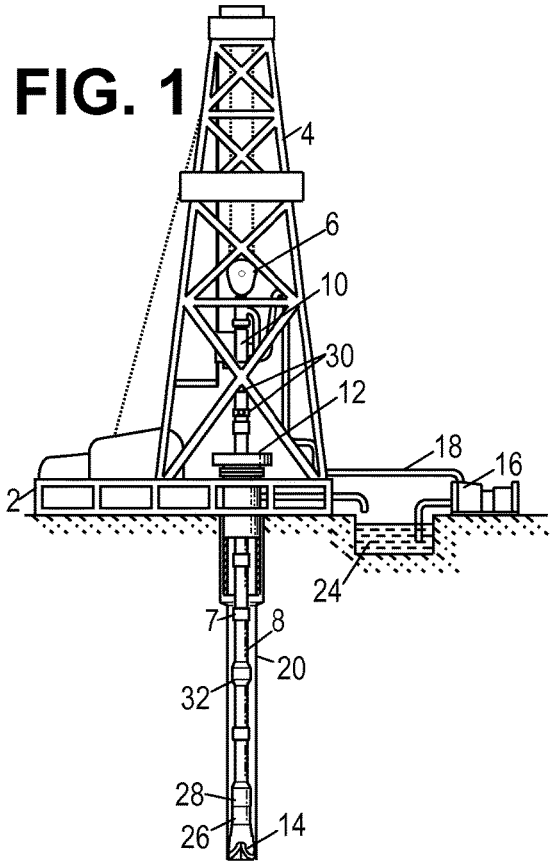
FIG. 1 is a schematic view of an illustrative drilling environment in which a downhole telemetry system may be employed.

It should be understood, however, that the specific embodiments given in the drawings and detailed description thereto do not limit the disclosure, but on the contrary, they provide the foundation for one of ordinary skill to discern the alternative forms, equivalents, and modifications that are encompassed with the given embodiments by the scope of the appended claims.

DETAILED DESCRIPTION

As one method for increasing the rate of transmission of logging while drilling (LWD) telemetry data, it has been proposed to transmit the data using compressional acoustic waves in the tubing wall of the drill string rather than depending on pressure pulses in the drilling fluid. Many physical constraints present challenges for this type of telemetry. Acoustic wave propagation through the drill string encounters attenuation and scattering due to the acoustic impedance mismatch at pipe joints. The resulting transfer function is lossy and has alternating stop and pass bands that lead to substantial intersymbol interference. As we show herein, this intersymbol interference can be at least partially compensated through the use of time-reversal pre-equalization.

Turning now to the figures, FIG. 1 shows a well during drilling operations. A drilling platform 2 is equipped with a derrick 4 that supports a hoist 6. Drilling of oil and gas wells is carried out by a string of drill pipes connected together by "tool" joints 7 so as to form a drill string 8. The hoist 6 suspends a top drive 10 that is used to rotate the drill string 8 and to lower the drill string through the well head 12. Connected to the lower end of the drill string 8 is a drill bit 14. The bit 14 is rotated and drilling accomplished by rotating the drill string 8, by use of a downhole motor near the drill bit, or by both methods. Drilling fluid, termed "mud", is pumped by mud recirculation equipment 16 through supply pipe 18, through top drive 10, and down through the drill string 8 at high pressures and volumes to emerge through nozzles or jets in the drill bit 14. The mud then travels back up the hole via the annulus formed between the exterior of the drill string 8 and the borehole wall 20, through a blowout preventer, and into a mud pit 24 on the surface. On the surface, the drilling mud is cleaned and then recirculated by recirculation equipment 16. The drilling mud is used to cool the drill bit 14, to carry cuttings from the base of the bore to the surface, and to balance the hydrostatic pressure in the rock formations.

In wells employing acoustic telemetry for LWD, downhole sensors 26 are coupled to an acoustic telemetry transmitter 28 that transmits telemetry signals in the form of acoustic vibrations in the tubing wall of drill string 8. An acoustic telemetry receiver array 30 may be coupled to tubing below the top drive 10 to receive transmitted telemetry signals. One or more repeater modules 32 may be optionally provided along the drill string to receive and retransmit the telemetry signals. The repeater modules 32 include both an acoustic telemetry receiver array and an acoustic telemetry transmitter configured similarly to receiver array 30 and the transmitter 28.

Figure 2:
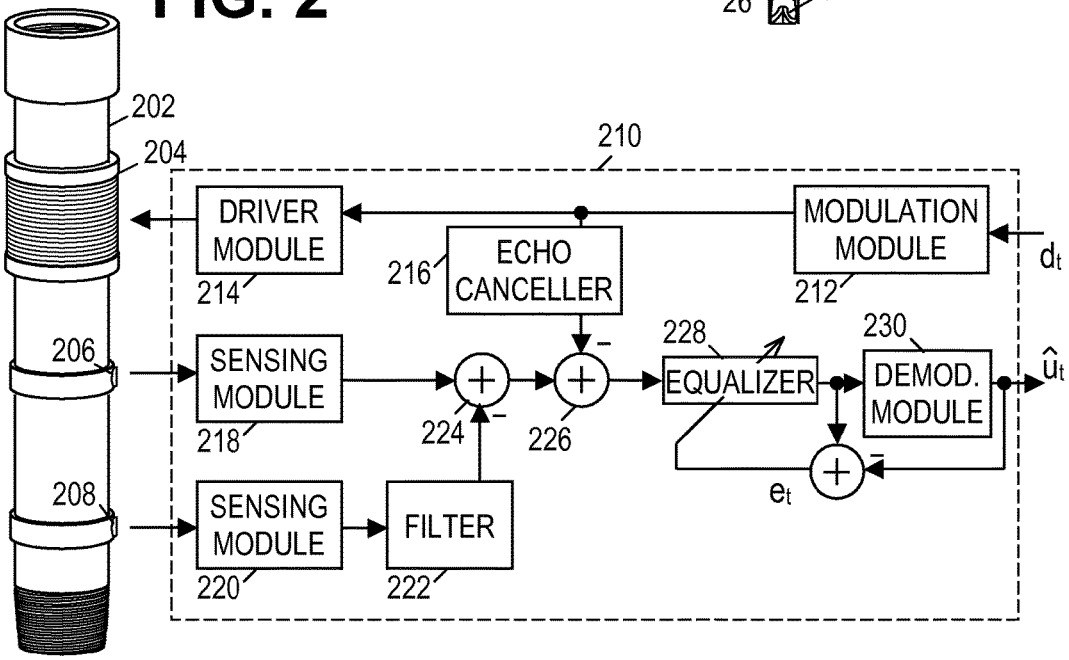
FIG. 2 shows an illustrative acoustic transceiver embodiment.

FIG. 2 shows an illustrative acoustic transceiver embodiment 202 having an acoustic transmitter 204 and two acoustic sensors 206, 208. Various suitable acoustic transmitters are known in the art, as evidenced by U.S. Pat. Nos. 2,810,546, 3,588,804, 3,790,930, 3,813,656, 4,282,588, 4,283,779, 4,302,826, and 4,314,365. The illustrated transmitter has a stack of piezoelectric washers sandwiched between two metal flanges. When the stack of piezoelectric washers is driven electrically, the stack expands and contracts to produce axial compression waves that propagate along the drill string. Other transmitter configurations may be used to produce torsional waves, radial compression waves, or even transverse waves that propagate along the drill string.

Various acoustic sensors are also known in the art, including pressure, velocity, and acceleration sensors. Sensors 206 and 208 may comprise two-axis accelerometers that sense accelerations along the axial and circumferential directions. One skilled in the art will readily recognize that other sensor configurations are also possible. For example, sensors 206 and 208 may comprise three-axis accelerometers that also detect acceleration in the radial direction. Additional sensors may be provided 90 or 180 degrees away from the sensors shown. A reason for employing such additional sensors stems from an improved ability to isolate and detect a single acoustic wave propagation mode to the exclusion of other propagation modes. Thus, for example, a multi-sensor configuration may exhibit improved detection of axial compression waves to the exclusion of torsional waves, and conversely, may exhibit improved detection of torsional waves to the exclusion of axial compression waves. U.S. Pat. No. 6,370,082 titled "Acoustic Telemetry System With Drilling Noise Cancellation" discusses one such sensor configuration.

Additional sensors may be spaced axially along the body of the transceiver 202. One reason for employing multiple, axially spaced sensors stems from an ability to screen out surface noise and improve the signal to noise ratio of the receive signal. Larger axial spacings within physical system constraints may be preferred. Another consideration, at least when tone burst signaling is employed, is the axial placement of the sensors relative to the end of the tool string. U.S. Pat. No. 6,320,820, titled "High data rate acoustic telemetry system" discusses a sensor placement strategy for such systems.

With an acoustic transceiver near the bit and an acoustic transceiver at the surface, two-way communications can take place, enabling commands to be communicated from the surface to the downhole tool assembly and enabling data from the downhole tool assembly to be communicated to the surface. The transceiver electronics 210 enable full-duplex communication. The transceiver electronics 210 may be implemented as one or more application specific integrated circuits (ASICs), or as a digital processor that executes software to perform the various functions shown.

The illustrated transceiver electronics 210 include a modulation module 212 configured to convert a downlink datastream $d_t$ into a transmit signal. In at least some embodiments, modulator 212 employs amplitude shift keying (ASK) modulation or frequency shift keying (FSK) modulation with time-reversed pre-equalization as discussed further below. Other suitable modulation schemes for use with time-reversed pre-equalization include phase shift keying (PSK), quadrature amplitude modulation (QAM), and orthogonal frequency division multiplexing (OFDM). A driver module 214 amplifies the transmit signal and provides the amplified signal to transmitter 204. (In digital embodiments of electronics 210, the driver module 214 may also provide digital-to-analog conversion.) An echo canceller 216 processes the transmit signal to estimate echoes not otherwise accounted for by the receive chain.

The receive chain in transceiver electronics 210 includes sensing modules 218, 220 that buffer signals detected by corresponding sensors 206, 208. The sensing modules may be configured to compensate for non-linearities or other imperfections in the sensor responses. Sensing modules 218, 220 may be further configured to provide analog-to-digital signal conversion. The received signal from one sensor module is filtered by filters 222, and the filter output is combined with the received signal from the other sensor module by adder 224 to provide directional detection, i.e., detection of signal energy propagating in one direction to the exclusion of signal energy propagating in the opposite direction. (Additional detail on the directional detection principle can be found in U.S. Pat. No. 8,193,946, titled "Training for Directional Detection".) Another adder 226 may combine the directional signal from adder 224 with an estimated echo signal from echo canceller 216 to obtain an "echo-cancelled" signal. An adaptive equalizer 228 maximizes the signal to noise ratio for demodulator 230.

Many suitable equalizers may be used, including linear equalizers, fractionally-spaced equalizers, decision feedback equalizers, and maximum likelihood sequence estimators. These are described in detail in Chapter 6 (pp. 519-692) of John G. Proakis, *Digital Communications*, Second Edition, McGraw-Hill Book Company, New York, ©1989. Each of the equalizers may be implemented in adaptive form to enhance their performance over a range of variable channel conditions. Filter adaptation is well known and is described in various standard texts such as Simon Haykin, *Adaptive Filter Theory*, Prentice-Hall, Englewood Cliffs, ©1986.

The adaptive equalizer 228 is followed by a demodulator 230. Demodulator 230 processes the filtered receive signal to estimate which channel symbols have been transmitted. The coefficients of adaptive equalizer 228 are dynamically adjusted to minimize the error between the input and output of the demodulator 230. In some embodiments, adaptation may also be applied to the coefficients of filter 216 to minimize the error between the input and output of the demodulator 230.

Figure 3:
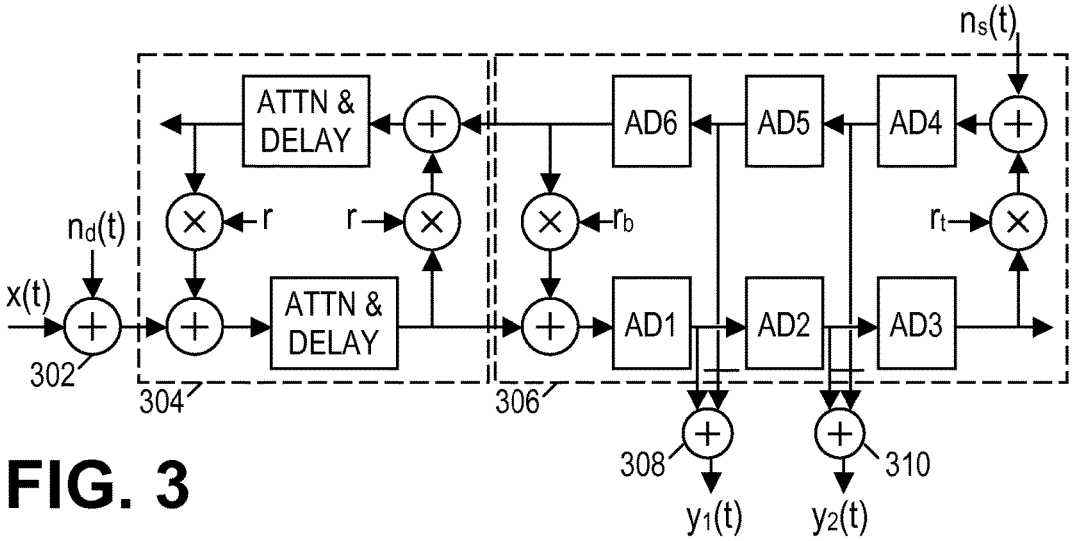
FIG. 3 is a block diagram of an illustrative acoustic channel model.

FIG. 3 show an illustrative channel model for acoustic propagation along a drillstring. The illustrative model provides for dual sensors, but it can be readily modified to match the number of sensors in the intended system. With at least two axially-spaced sensors, the acoustic energy propagating in one direction along the drillstring can be screened to improve the signal to noise ratio of any acoustic signals propagating in the opposite direction. See, e.g., U.S. Pat. No. 7,158,446, titled "Directional Acoustic Telemetry Receiver".

In FIG. 3, acoustic wave signal x(t) is a modulated form of a digital or analog telemetry signal. Adder 302 adds downhole noise $n_d(t)$ to the acoustic wave signal x(t). The downhole noise is caused in part by the operation of the drill bit as it crushes formation material. The crushing action creates compressional and torsional acoustic waves that propagate along the drill string in the same manner as the acoustic telemetry signal x(t). The noise-contaminated acoustic telemetry signal propagates through one or more pipe segment blocks 304. Each pipe segment block represents a pipe segment in the drill string. In addition accounting for the attenuation and delay experienced by the signal as it propagates along the drill pipe segment, the block 304 accounts for the pipe joints at each end of the drill pipe segment which create acoustic impedance changes that cause partial reflections of the acoustic energy propagating in each direction. The (nearly) periodic structure of the drill string produces a complex frequency response which has multiple stopbands and passbands.

Eventually, the upwardly-propagating acoustic waves reach a receiver segment 306. The receiver segment 306 also receives downwardly-propagating surface noise $n_s(t)$. The surface noise is caused at least in part by the drive motor(s) and rig activity at the surface. The receiver tubing segment 306 includes at least two acoustic sensors. A first sensor, represented by adder 308, is sensitive to acoustic waves propagating in both directions, yielding sensor signal $y_1(t)$. Similarly, a second sensor is represented by an adder 310 that is sensitive to acoustic waves propagating in both directions, yielding sensor signal $y_2(t)$. The sensors are separated by attenuation and delay blocks AD2 (in the upward direction) and AD5 (in the downward direction).

The model of FIG. 3 may be generalized somewhat with the following frequency-domain equations:

$$Y_1(f)=H_{X1}(f)[X(f)+N_d(f)]+H_{N1}(f)N_S(f) \quad (1)$$

$$Y_2(f)=H_{X2}(f)[X(f)+N_d(f)]+H_{N2}(f)N_S(f) \quad (2)$$

It is shown in U.S. patent application Ser. No. 12/065,529, titled "Training for Directional Detection" that the received directional signal can be obtained and expressed as follows:

$$[N_{N2}(f)/H_{N1}(f)]Y_1(f)-Y_2(f)=Q(f)[X(f)+N_d(f)], \quad (3)$$

where $$Q(f)=[H_{N2}(f)/H_{N1}(f)]H_{X1}(f)-H_{X2}(f). \quad (4)$$

In the discussion that follows we will refer to the "channel response". In embodiments such as a single-sensor system, this channel response can be the impulse response of the channel, i.e., the time domain version of $H_{X1}(f)$ from equation (1) above. This selection can also apply to a multi-sensor system where one sensor is chosen as a representative sensor. Alternatively, the impulse response measurements from each sensor can be combined to obtain an average impulse response. As a preferred option, the impulse response for the combined signal from the multiple sensors may be chosen, i.e., the time domain version of Q(f) from equation (4) above.

The channel response need not be limited to the impulse response. It can also be the received signal when a pulse is sent, i.e., the convolution of the selected impulse response with a selected pulse. The selected pulse can be a square pulse, a raised cosine pulse, a Gaussian pulse, or any suitable constituent of a signal transmission for the drillstring acoustic channel.

Figure 4A:
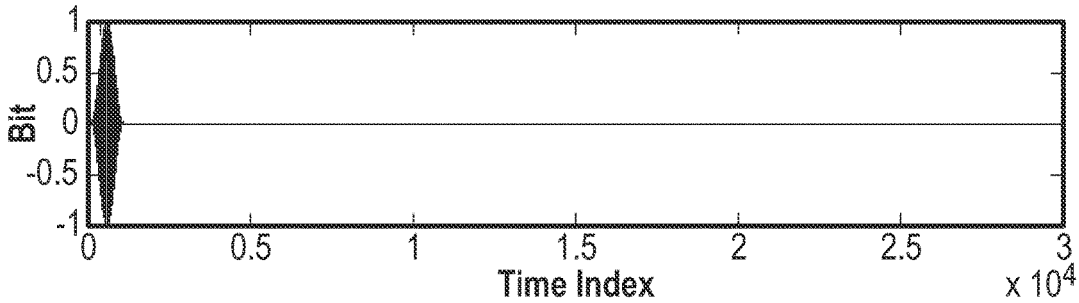
FIG. 4A shows an illustrative modulated channel symbol.
Figure 4B:
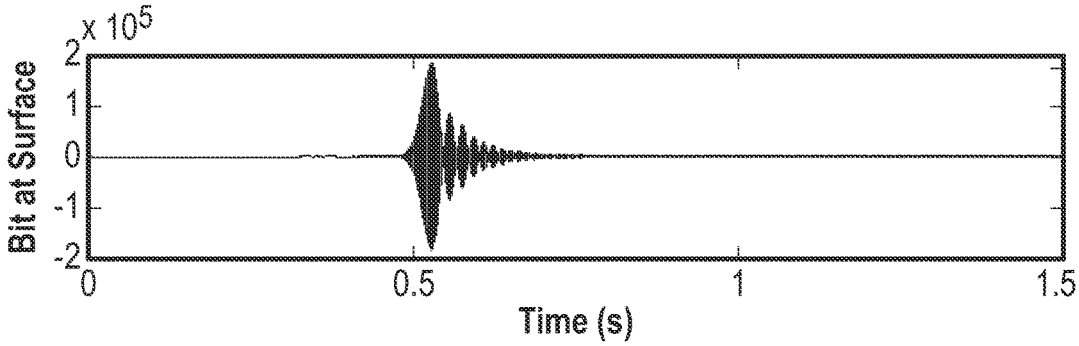
FIG. 4B shows an illustrative received channel symbol.
Figure 4C:
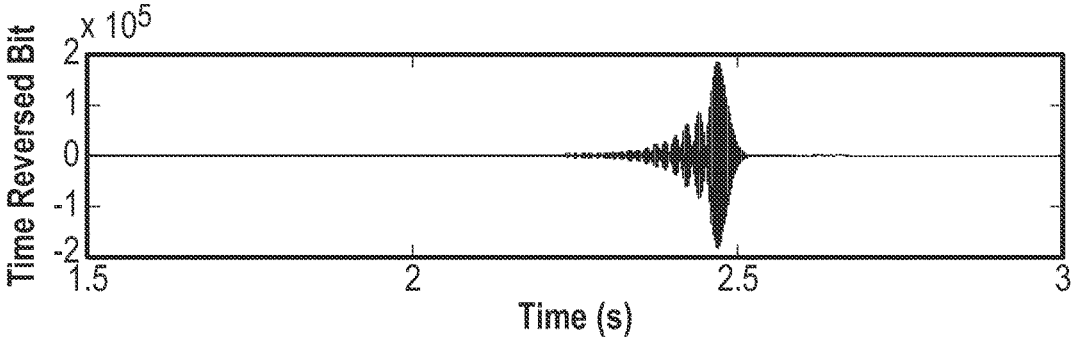
FIG. 4C shows an illustrative time-reversed channel symbol.

FIG. 4A shows an illustrative signal x(t) representing a "1" bit in the form of a FSK-modulated pulse (a Hanning-windowed tone burst) having the frequency that corresponds to a "1". (A second frequency is used to represent a "0".) The illustrative signal energy is fully contained within an interval representing about 50 milliseconds. FIG. 4B shows an illustrative received signal y(t) representing the transmitted signal x(t) after it has passed through a simulated drillstring acoustic channel. The signal energy is no longer well-contained and has significant energy contributions distributed over a 300 millisecond time interval. If multiple data symbols were to be sent in a closely distributed fashion, this spreading would cause the data symbols to interfere with each other. FIG. 4C shows a time-reversed version of the received signal. Due to the time reversal, this signal represents a modulated symbol convolved with a time-versed channel response.

Figure 5A:
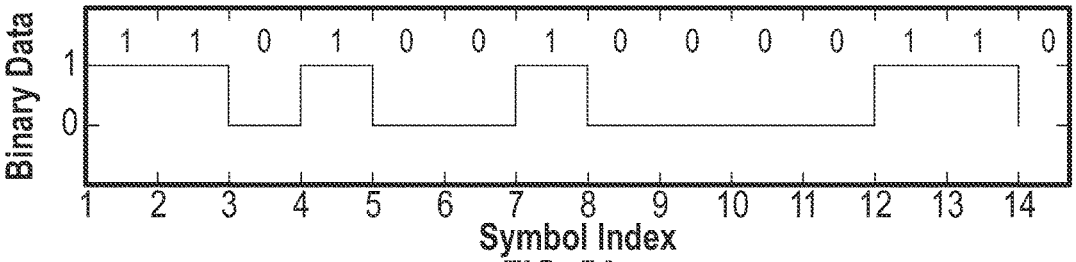
FIG. 5A shows an illustrative bit sequence.
Figure 5B:
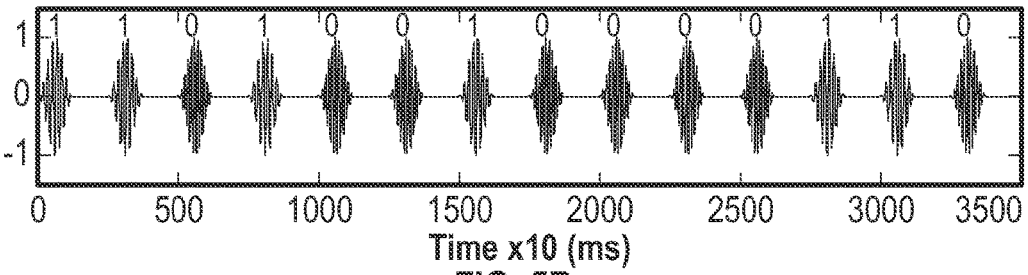
FIG. 5B shows a corresponding sequence of modulated channel symbols.
Figure 5C:
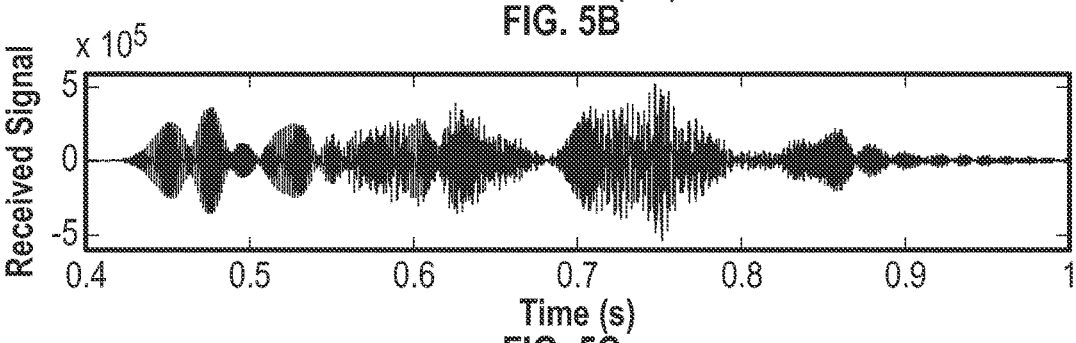
FIG. 5C shows an illustrative received channel symbol sequences without pre-equalization.

FIG. 5A shows an illustrative binary data sequence, i.e., a series of bit values. FIG. 5B shows a corresponding transmit signal x(t) having series of modulated tone bursts with a first frequency representing "1" and a second frequency representing "0". The pulses are provided with a pulse width of about 50 milliseconds, with one pulse every 100 milliseconds. FIG. 5C shows an illustrative received signal y(t) corresponding to the transmitted signal x(t) with no pre-equalization. Note that the intersymbol interference makes the received signal difficult to demodulate even in the absence of any noise.

Figure 5D:
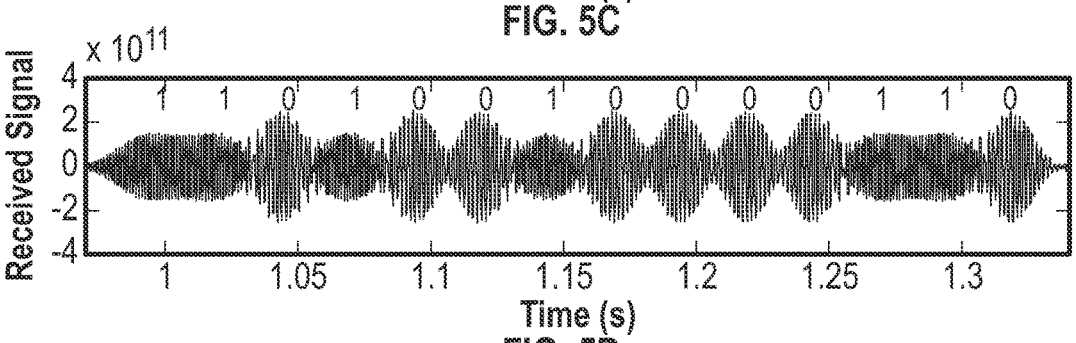
FIG. 5D shows an illustrative received channel symbol sequence with a first pre-equalization method.

For comparison, FIG. 5D shows an illustrative received signal with time-reversal pre-equalization. In this embodiment, the transmitted signal x(t) was generated with a sequence of time-reversed bit symbols (such as that shown in FIG. 4C). Note the clear correspondence between the received signal in FIG. 5D and the original binary data in FIG. 5A. The symbol intervals with the higher frequency signal are well-defined and easily distinguishable from the symbol intervals with the lower frequency signals.

Figure 5E:
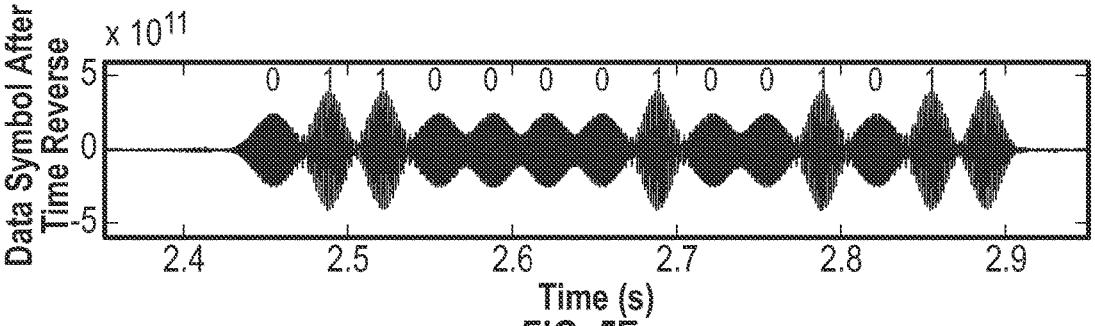
FIG. 5E shows an illustrative received channel symbol sequence with a second pre-equalization method.

One additional comparison is provided in FIG. 5E. This figure shows a received signal y(t) corresponding to the transmit signal x(t) being a time-reversed version of FIG. 5C. That is, rather than assembling a transmit signal on a symbol-by-symbol basis, the transmit signal is obtained by time-reversing the response to a sequence of symbols. Note that the resulting received signal offers even better definition between symbol intervals due to the use of a larger signal window. The demodulated bit sequence, however, is reversed, so this reversal would need to be accounted for in the transmitter or receiver.

Figure 6:
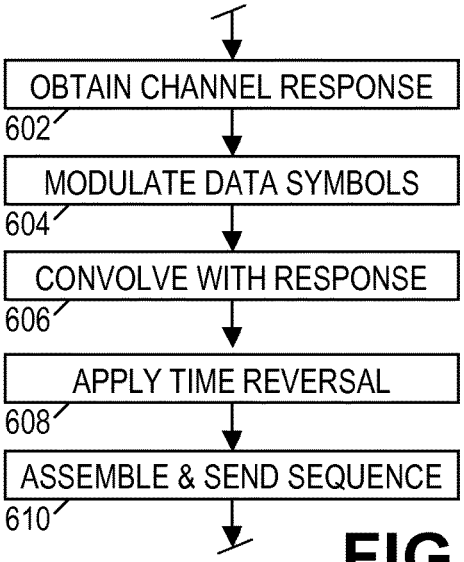
FIG. 6 is a flow diagram of an illustrative telemetry method in accordance with some disclosed embodiments.

Accordingly, FIG. 6 shows an illustrative telemetry method that can be implemented by the transmitter component(s) of an acoustic telemetry system. Once activated, the acoustic transmitters each obtain a channel response in block 602. This can be done in a number of ways. A first approach to obtaining the channel response is to transmit a short pulse to the receiver, which detects the resulting receive signal and returns it to the transmitter via some alternate means of communication, e.g., a mud pulse telemetry system. A second approach is to transmit a frequency sweep or other signal suitable for measuring the frequency spectrum. As before, the receiver sends the measurements back to the transmitter. These first two approaches require a secondary channel which in some cases may not be available.

A third approach is to receive a signal from a remote transmitter and derive a channel response from the received signal. Under the reciprocity principle, this channel response should be suitable for use by the local transmitter. A fourth approach is to analyze the noise spectrum to derive a channel response (using the assumption that the noise spectrum indicates the spectral response of the channel). A fifth approach is to calculate the channel response theoretically based on a channel model such as that given in FIG. 3 above. With parameters for drillpipe dimensions and acoustic properties, tool joint dimensions and acoustic properties, and statistical variation of the dimensions, a theoretical calculation of the channel response can be fairly accurate. The number of drillpipes in the string can be derived by the downhole transmitter using various techniques including position measurement.

In block 604 the acoustic transmitters modulate the data symbol(s) internally to obtain the various un-equalized channel symbols. For amplitude shift keying, only one channel symbol need be obtained, as the other symbols will simply be scaled versions. For frequency shift keying, each channel symbol may be obtained. FIG. 4A is one example of a channel symbol. In certain alternative embodiments, the acoustic transmitter modulates a sequence of data symbols to obtain a channel symbol sequence.

In block 606, the acoustic transmitters convolve the channel symbol(s) with the channel response. One technique is to employ the Fourier transform to obtain the frequency-domain representations of the channel symbols, multiply these with the frequency-domain channel response, and take the inverse Fourier transform of the product. Another technique is to actually convolve the time-domain representations of the channel symbols with the time-domain channel response.

In block 608, the acoustic transmitters time-reverse the channel symbols to obtain the pre-equalized channel symbols. These pre-equalized channel symbols can then be stored in memory for use in the subsequent step.

In block 610, the acoustic transmitters assemble and send a sequence of pre-equalized channel symbols. The sequence can be assembled by adding partially-overlapped copies of the stored representations. The channel symbol rate can be controlled by varying the amount of overlap, thereby delaying the start of each subsequent symbol by the desired symbol interval.

Numerous other variations and modifications will become apparent to those skilled in the art once the above disclosure is fully appreciated. For example, the foregoing description was made in the context of a drilling operation, but such acoustic telemetry may also take place through coiled tubing, production tubing or any other length of acoustically transmissive material in or out of a borehole. Repeaters may be included along the drill string to extend the signaling range. In addition to LWD and producing while drilling, the disclosed telemetry systems can be employed for production logging using permanently installed sensors, smart-wells, and drill stem testing. The principles of time-reversal pre-equalization are not limited to acoustic telemetry, but can also be employed in other downhole telemetry systems including, e.g., mud pulse telemetry. It is intended that the following claims be interpreted to embrace all such variations and modifications where applicable.

What is claimed is:

1. A downhole telemetry system that comprises:

an acoustic transducer that transmits an acoustic signal to a receiver via a string of drillpipes connected by tool joints such that the acoustic signal is transmitted along the string of drillpipes one drillpipe after another; and a digital signal processor that drives the acoustic transducer with an electrical signal that represents modulated digital data convolved with a time-reversed channel response corresponding to the transmission along the string of drillpipes one drillpipe after another, wherein the digital signal processor determines the time-reversed channel response based on a model, parameters of the model including an estimated number of drillpipes in the string.

2. The system of claim 1, wherein the digital signal processor convolves a modulated signal with the time-reversed channel response to obtain said electrical signal.

3. The system of claim 2, wherein the acoustic transducer is part of a transceiver, and wherein the digital signal processor processes received signals to determine the time-reversed channel response.

4. The system of claim 1, wherein the acoustic transducer is part of a transceiver, and wherein the digital signal processor derives from a received signal a representation of each channel symbol, wherein the digital signal processor stores said representations, and wherein the digital signal processor generates said electrical signal by overlapping and adding said representations in a sequence.

5. The system of claim 1, wherein the digital data is modulated with frequency-shift keying.

6. The system of claim 1, wherein the digital data is modulated with amplitude-shift keying.

7. The system of claim 1, wherein the digital data is modulated with phase-shift keying, quadrature amplitude modulation, or orthogonal frequency division multiplexing.

8. A downhole telemetry method that comprises:

generating an electrical signal that represents modulated digital data convolved with a time-reversed response of an acoustic channel that includes a string of drillpipes connected by tool joints, the time-reversed response corresponding to transmission along the string of drillpipes one drillpipe after another;

driving an acoustic transducer with the electrical signal to communicate the modulated digital data along the string of drillpipes one drillpipe after another to a receiver; and determining the time-reversed response using a model, parameters of the model including a variable number of drillpipes in the acoustic channel.

9. The method of claim 8, wherein said generating includes convolving a modulated signal with a channel response and time-reversing the result to obtain said electrical signal.

10. The method of claim 8, wherein said generating includes convolving a modulated signal with the time-reversed response to obtain said electrical signal.

11. The method of claim 10, further comprising:

processing received signals to extract a determined channel response; and storing a time-reversed version of the determined channel response.

12. The method of claim 8, further comprising:

extracting from a received signal a representation of each channel symbol;

storing a time-reversed version of each channel symbol representation; and assembling a sequence of said stored channel symbol representations.

13. The method of claim 8, wherein the modulated digital data is frequency-shift keyed.

14. The method of claim 8, wherein the modulated digital data is amplitude-shift keyed.

15. The method of claim 8, wherein the modulated digital data is phase-shift keyed, quadrature amplitude modulated, or modulated via orthogonal frequency division multiplexing.

16. A downhole telemetry method that comprises:

generating an electrical signal that represents modulated digital data convolved with a time-reversed response of an acoustic channel that includes a string of drillpipes connected by tool joints, the time-reversed response corresponding to transmission along the string of drillpipes one drillpipe after another;

driving an acoustic transducer with the electrical signal to communicate the modulated digital data along the string of drillpipes one drillpipe after another to a receiver;

determining the time-reversed response using a model, parameters of the model including a variable number of drillpipes in the acoustic channel;

obtaining a frequency-domain channel response and storing the frequency-domain channel response in memory;

generating each possible modulated channel symbol;

frequency transforming each modulated channel symbol;

multiplying each frequency transformed channel symbol with the frequency-domain channel response to obtain corresponding products;

inverse transforming the products to obtain time-domain convolutions;

time-reversing the time-domain convolutions to obtain channel symbol representations; and assembling the channel symbol representations into a sequence to obtain said electrical signal.

17. The method of claim 16, wherein the modulated channel symbols are frequency-shift keyed representations of a binary 0 and a binary 1.

* * * * *